US007607496B2

(12) United States Patent
Southard

(10) Patent No.: US 7,607,496 B2
(45) Date of Patent: Oct. 27, 2009

(54) DRILLING APPARATUS AND SYSTEM FOR DRILLING WELLS

(76) Inventor: Robert Charles Southard, 2700 Post Oak Blvd., Ste. 1400, Houston, TX (US) 77056

( * ) Notice: Subject to any disclaimer, the term of this patent is extended or adjusted under 35 U.S.C. 154(b) by 303 days.

(21) Appl. No.: 11/713,942

(22) Filed: Mar. 5, 2007

(65) Prior Publication Data

US 2008/0217062 A1 Sep. 11, 2008

(51) Int. Cl.
*E21B 7/08* (2006.01)

(52) U.S. Cl. ..... 175/57; 175/107; 175/257

(58) Field of Classification Search ..... 175/57, 175/107, 257

See application file for complete search history.

(56) References Cited

U.S. PATENT DOCUMENTS

| | | | | |
|---|---|---|---|---|
| 1,391,626 | A | 9/1921 | Gilthorpe | |
| 3,181,631 | A * | 5/1965 | Nielsen | 175/96 |
| 3,669,199 | A | 6/1972 | Cullen et al. | |
| 4,544,041 | A | 10/1985 | Rinaldi | |
| 4,842,081 | A | 6/1989 | Parant | |
| 5,197,553 | A | 3/1993 | Leturno | |
| 5,271,472 | A | 12/1993 | Leturno | |
| 5,472,057 | A | 12/1995 | Winfree | |
| 5,845,721 | A | 12/1998 | Southard | |
| 5,957,224 | A | 9/1999 | Ilomaki | |
| 6,488,103 | B1 | 12/2002 | Dennis et al. | |
| 6,543,552 | B1 | 4/2003 | Metcalfe et al. | |
| 6,742,606 | B2 | 6/2004 | Metcalfe et al. | |
| 2004/0112639 | A1 | 6/2004 | Chen et al. | |

* cited by examiner

*Primary Examiner*—William P Neuder
(74) *Attorney, Agent, or Firm*—Matthews, Lawson & Bowick PLLC

(57) ABSTRACT

A device for boring a well with casing. The device is attached to a motor that has a power shaft for imparting rotational movement. The device comprises a driver operatively connected to the power shaft, with the driver containing a cylindrical body, a first bit having a first end connected to the driver so that rotational movement of the driver is imparted to the first bit, and a sleeve disposed about the power shaft, and wherein the sleeve has a radial shoulder. The device further includes casing attached to the sleeve, and wherein the casing is designed to be permanently placed within the well once the boring is completed. The device further comprises a housing disposed about the driver, a second bit attached to the housing, and a planetary gear anchored to the radial shoulder, and wherein the planetary gear is adapted for imparting rotation from the driver to the housing in a counter radial direction.

19 Claims, 6 Drawing Sheets

DRILLING APPARATUS AND SYSTEM FOR DRILLING WELLS

BACKGROUND OF THE INVENTION

This invention relates to a novel drilling device and method of drilling a well. More particularly, but not by way of limitation, this invention relates to a non-reactive torque device that contains an inner bit and a counter-rotating outer bit. This invention also describes a method of drilling the well. The novel device will significantly reduce the reactive torque generated during the drilling phase.

In the search for oil and gas, operators have utilized various types of devices in order to drill wells. Operators are continually searching for ways to drill the wells faster and more economically. Traditionally, a specifically designed drill string was used to drill wells. The drill string would have attached thereto a drill bit. In order to drill the well, the driller would cause the drill string to rotate which would in turn cause the bit to rotate, and hence, drill the well. Over the years, various types of drill strings have been developed in order to drill directional, or inclined, well bores.

Further, different types of bottom hole assemblies have also been developed in order to drill these wells. Thus, a typical directional drill string may contain a bottom hole assembly which includes: a bit, bent sub, drilling motor, and measurement-while-drilling surveying and logging tools. With this type of bottom hole assembly, the drill string ideally is held stationary with respect to down hole rotation. The drilling motor generates rotation of the bit via circulation of the drilling fluid through the drilling motor as is well understood by those of ordinary skill in the art. With the drill string held stationary with respect to rotation, the well is drilled in the desired, controlled direction of the bend in the bent sub.

A common problem with this type of drilling assembly is the torque generated by the bit. The bit torque generates an equal and opposite reactive torque that is transferred from the motor into the bottom hole assembly and drill string, causing it to counter-rotate, relative to the bit. Further, the reactive torque, and hence the drill sting counter-rotation, varies due to drilling conditions, such as the weight applied to the bit, properties of the rock being drilled, and hole condition, which all vary independently of each other. As the bent sub is part of the bottom hole assembly being counter-rotated, the direction in which the well is being drilled changes with the changes in reactive torque.

As a result, the directional driller is required to make numerous surface adjustments of the drill string, and hence the bent sub, to maintain drilling in the desired direction. These numerous adjustments cost valuable rig time and reduce the efficiency of the drilling operation. By eliminating, or greatly reducing, the reactive torque in the bottom hole assembly and drill string, drilling can proceed unabated in the desired direction, saving valuable rig time. Other benefits of eliminating, or reducing, reactive torque include the ability to use more powerful motors and more weight on bit to increase drilling rates and drilling a smoother, less tortuous borehole for running logging tools and setting casing. A non-reactive bit apparatus and method were disclosed in U.S. Pat. No. 5,845,721 entitled "Drilling Device And Method Of Drilling Wells", which is incorporated herein by express reference.

As those of ordinary skill in the art will appreciate, daily rig cost are substantial. In many cases after a well is drilled, the well is prepared for running and cementing a casing string into the well. Hence, any time saved cleaning, running and cementing the casing converts to significant cost savings. Prior art tools have not allowed an operator to effectively drill with a casing string forming a part of the work string due to structural limitations of the casing string and the casing string thread connections. In other words, the casing strings and casing string connections are not structurally designed to handle the stress and strain applied by the numerous torquing requirements for a drill string. However, with the advent of the non-reactive torque drilling device herein described, drilling with an attached casing string is possible. Numerous advantages and features flow from the non-reactive torque drilling device.

Therefore, there is a need for a drilling device that will allow the drilling of a well with a casing string attached thereto. There is also a need for a non-reactive drilling tool with dual bits, and wherein the casing string is left within the well after cessation of drilling operations. Under this scenario, the casing string can be cemented in place and other remedial well work can be performed, wherein the remedial well work includes perforating the casing in order to produce hydrocarbon from a subterranean reservoir.

SUMMARY OF THE INVENTION

An apparatus for drilling a well bore with a down hole motor is disclosed. The down hole motor contains a power shaft for imparting rotational movement. In one preferred embodiment, the apparatus comprises a driver operatively connected to the power shaft, with the driver having a cylindrical body, and wherein an outer portion of the cylindrical body contains a plurality of cogs. The apparatus further contains a first bit having a first end, and wherein the first end is connected to the driver so that rotational movement of the driver is imparted to the first bit, and a sleeve disposed about a portion of the power shaft, with the sleeve having a plurality of openings therein for placement of a plurality of pinions. The pinions have a pin disposed there through, and wherein the sleeve has a radial shoulder for attaching the plurality of pins. A housing is included, and wherein a second bit is formed on a first end, and wherein the housing has an internal portion that contains internal cogs, and wherein said internal cogs engage said pinions so that as said driver rotates in a first direction, rotation is imparted to said pinions which in turn imparts a counter rotation to said second bit.

In one most preferred embodiment, the driver contains an outer radial surface that is disposed within the sleeve, and wherein the outer radial surface contains an outer coating material for preventing wear with the sleeve during rotation. The apparatus further comprises thrust bearing means, operatively positioned within the housing, for transferring the axial and lateral loads of the apparatus during drilling. The thrust bearing means generally comprises a thrust mandrel disposed between the housing and the driver, and a plurality of roller bearings operatively associated with the thrust mandrel. A trim spacer may also be included, and wherein the trim spacer is disposed within the housing and abutting the thrust mandrel, for engaging with the thrust mandrel. In the most preferred embodiment, the first bit is offset relative to the second bit so that the first bit extends further into the well bore relative to the second bit.

In one embodiment, the sleeve is attached to a coiled tubing string. In another embodiment, the downhole motor and planetary bit driver is attached to a work string. And, in the most preferred embodiment, the sleeve is attached to a casing string.

A method of drilling a well with a motor having a power shaft is also disclosed. The method comprises providing a drilling apparatus, with the drilling apparatus comprising a driver operatively connected to the power shaft, with the driver having a cylindrical body containing a plurality of cogs. The drilling apparatus also includes: a first bit having a first end connected to the driver so that rotational movement of the driver is imparted to the first bit; a sleeve disposed about a portion of the power shaft, with the sleeve having a plurality of openings therein for placement of a plurality of pinions, with the pinions having a pin disposed there through, and wherein the sleeve has a radial shoulder for attaching the plurality of pins. The drilling apparatus further includes a housing having a second bit formed thereon, and wherein the housing has an internal portion that contains a plurality of internal cogs engaging the pinions.

The method further comprises providing a casing string concentrically placed within the well, with the casing string being operatively connected to the sleeve, rotating the power shaft via a fluid flow down an internal portion of the casing string and the drilling apparatus, and rotating the first bit in a first direction. The method further includes drilling the well with the first bit, rotating the cogs on the driver, engaging the pinions with the cogs on the driver, and engaging the internal cogs on the housing. The method then comprises rotating the housing in a counter direction relative to the first bit, rotating the second bit in the counter direction, and drilling the well with the second bit. In one embodiment, the first bit is offset relative to the second bit so that the first bit extends further into the well relative to the second bit.

In the preferred embodiment, the method further includes terminating the flow of the fluid down the internal portion of the casing string and the drilling apparatus, and terminating the drilling of the well with the first bit and the second bit. Next, the internal portion of the drilling apparatus, including the first bit, is retrieved from the well. The casing string can then be cemented in place within the well. The method further includes perforating the casing sting so that the inner portion of the casing string is in communication with a subterranean reservoir.

In yet another preferred embodiment, a device for boring a well is disclosed. In this most preferred embodiment, the device is attached to a motor and wherein the motor has a power shaft for imparting rotational movement. The apparatus comprising a driver mandrel operatively connected to the power shaft, with the driver mandrel containing a cylindrical body. Also included is a first bit member having a first end and a second end, and wherein the first end is connected to the driver mandrel so that rotational movement of the driver mandrel is imparted to the first bit member, and wherein the first bit member has an inner bore. A sleeve is disposed about a portion of the power shaft, and wherein the sleeve has a radial shoulder. In this preferred embodiment, a casing string is attached to the sleeve, and wherein the casing string is designed to be permanently placed within the well once the boring is completed, and wherein the inner bore of the casing string is in fluid communication with the inner bore of the first bit. The device further includes a housing disposed about the driver mandrel, a second bit member attached to the housing, and a planetary gear anchored to the radial shoulder and disposed between the driver mandrel and the housing, and wherein the planetary gear is adapted for imparting rotation from the driver mandrel to the housing in a counter radial direction.

The device may further comprise thrust bearing means, operatively placed between the housing and the driver mandrel, for transferring the axial and lateral loads generated during boring. The thrust bearing means comprises a thrust mandrel and a plurality of ball bearings operatively associated with the thrust mandrel. A bearing assembly may also be included, wherein the bearing assembly having a first end and a second end, with the second end of the motor housing being rotatably associated with the first end of the bearing assembly so that rotation of the first bit member and the second bit member is facilitated. Additionally, the first bit includes a first set of cutter teeth positioned to drill the well in the first rotational direction and the second bit includes a second set of cutter teeth positioned to drill the well in the counter rotational direction. Also, in the most preferred embodiment, the first bit member is offset relative to the second bit member so that the first bit member extends further into the well relative to the second bit member.

ADVANTAGES

An advantage of the present invention is the ability to drill with non-reactive torque utilizing a first bit and a second concentric bit. An advantage of the present system is that wells can be drilled and completed faster. Another advantage is that the work string used with the dual bit is a casing string. Yet another advantage is that the casing string can be left in the hole after the intended total depth of the well is reached.

Still yet another advantage is that after drilling the well, the well can be cemented. By cementing the well quicker than prior art methods, the well will experience less skin damage to potential hydrocarbon bearing reservoirs. Another advantage is that operators will realize significant cost savings due to significantly faster completion times. Another feature is that the drilling apparatus can utilize coiled tubing string as a work string, and wherein drilling is possible utilizing the coiled tubing string due to the non-reactive torque produced by the disclosed drilling apparatus.

A feature of the present invention includes the ability to drill-in with the casing string without the need to pull the entire length of casing string from the well. Yet another feature is that the casing string can be cemented into the well. Yet another feature is the option to perforate the casing string to produce hydrocarbon reservoir. Another feature is that the drill-in casing string can employ the same thread connection means used on commercially available casing strings. In other words, commercially available thread means can be used with the drill-in casing. Yet another feature is the pinions are mounted about pins, and wherein the pins are mounted on a radial shoulder of the sleeve, and therefore, the pinions are capable of rotation. Still yet another feature is that the down hole motors used with the disclosed system are commercially available.

DETAILED DESCRIPTION OF THE PREFERRED EMBODIMENTS

Figure 1:
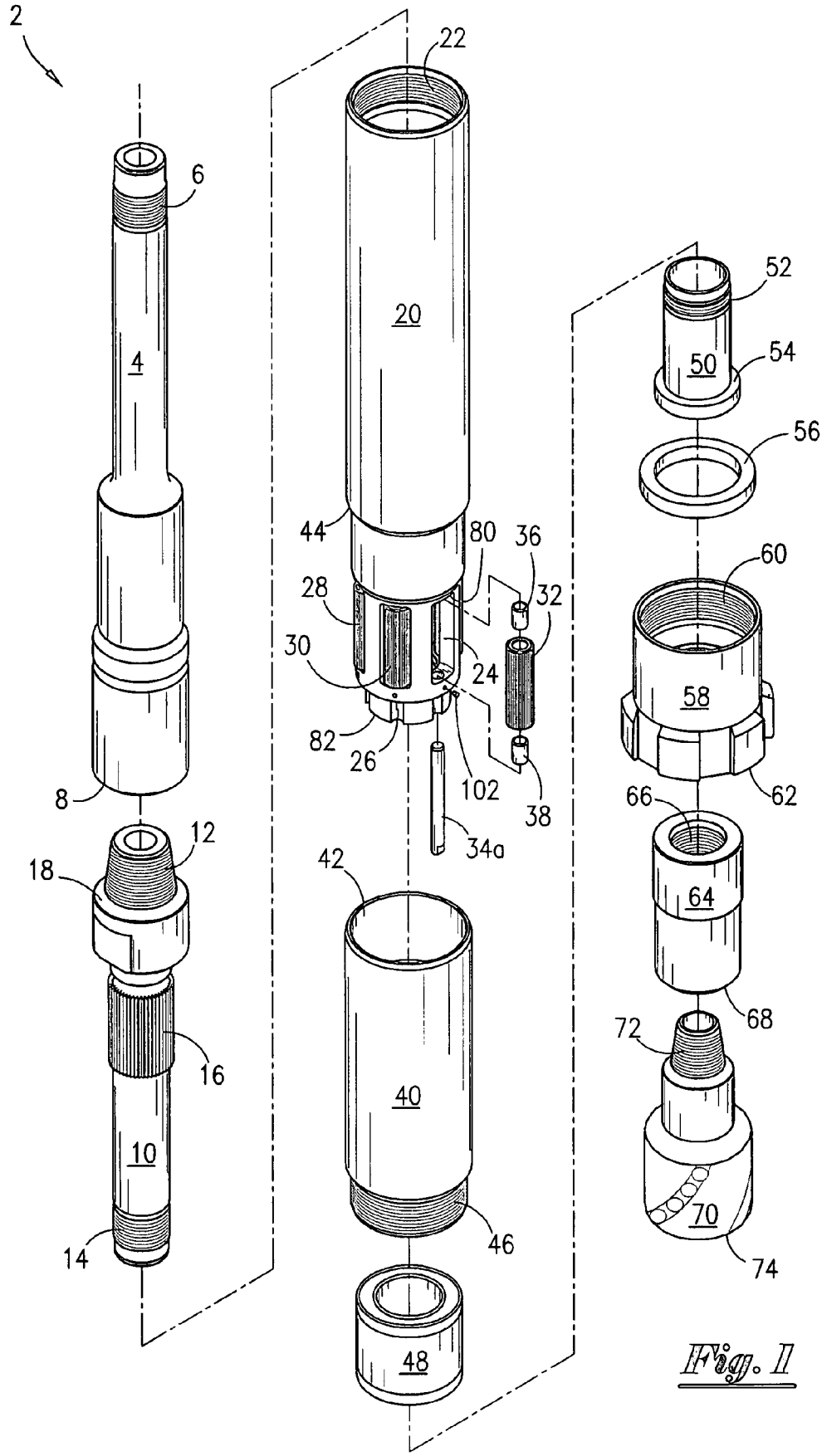
FIG. 1 is a perspective view of the drilling apparatus of the present disclosure.

Referring now to FIG. 1, a perspective view of the drilling apparatus 2 of the present disclosure will now be described. The power shaft 4 has a first end with external threads 6 and a second end with internal threads 8. A driver 10 will threadedly connect with the power shaft 4. The driver 10 has a first end having external threads 12 that will engage with the internal threads 8 and a second end having external threads 14. As seen in FIG. 1, driver 10 has a cylindrical body having a plurality of cogs 16 (sometimes referred to as splines 16) as well as the raised shoulder 18. A sleeve 20 is included, and wherein the sleeve 20 has internal thread means 22 on one end and a second end having a plurality of openings, such as seen at 24. Also, on the radial end, a plurality of indentations have been formed, such as seen at 26.

FIG. 1 also depicts the pinions 28, 30, 32, and wherein the pins will be disposed therethrough for rotation. Hence, the pin 34*a* will be disposed through pinion 32 as well as the bushings 36, 38. The pins (for instance pin 34*a*) will cooperate to engage with a radial shoulder located within the openings of the housing 20. FIG. 1 also illustrates the housing 40 which will have a first end 42 that will abut the ledge 44 of the sleeve 20. The housing 40 also contains the external threads 46 on the second end.

Figure 2A:
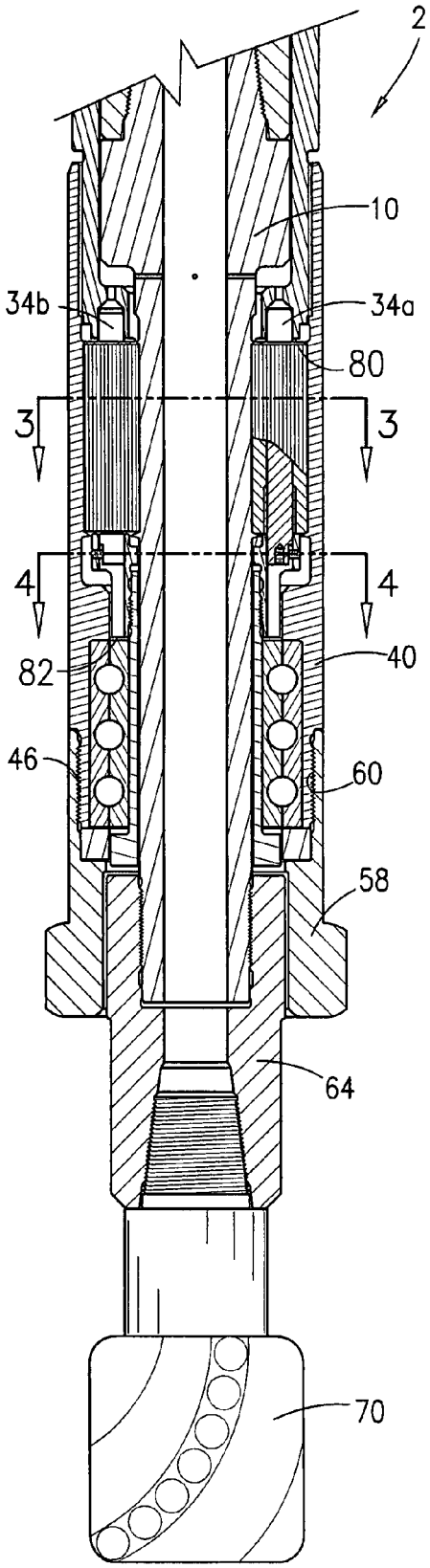
FIGS. 2A, 2B and 2C are a cross-sectional view of the drilling apparatus of the present disclosure.

FIG. 1 also depicts the thrust pack cylindrical assembly 48 which comprises a plurality of ball bearings (not seen in this view), and wherein the thrust pack assembly 48 (the thrust pack assembly 48 is commercially available) will be disposed about the thrust mandrel 50. As seen in FIG. 1, the thrust mandrel 50 has a first end having external threads 52 and a second end having a lip 54. The trim spacer 56 is included, and wherein the trim spacer 56 is a ring member that cooperates with the thrust mandrel 50 as well as the thrust pack 48, as seen in FIG. 2A. Returning to FIG. 1, the outer bit 58 is depicted, and wherein the outer bit 58 has a first end having internal threads 60 and a second end that contains the bit face 62. As seen in FIG. 1, bit face 62 contains indentations for allowing fluid and debris circulation, as well understood by those of ordinary skill in the art. The cross-over 64 contains a generally cylindrical body having internal threads 66 that will engage with the external threads 14. The cross-over 64 will also have internal threads 68. FIG. 1 also depicts the inner bit 70, and wherein the inner bit 70 has a first end including external threads 72 that will mate with the internal threads 68. The second end of the inner bit 70 contains the cutting face 74 for boring the well, as understood by those of ordinary skill in the art.

Figure 2B:
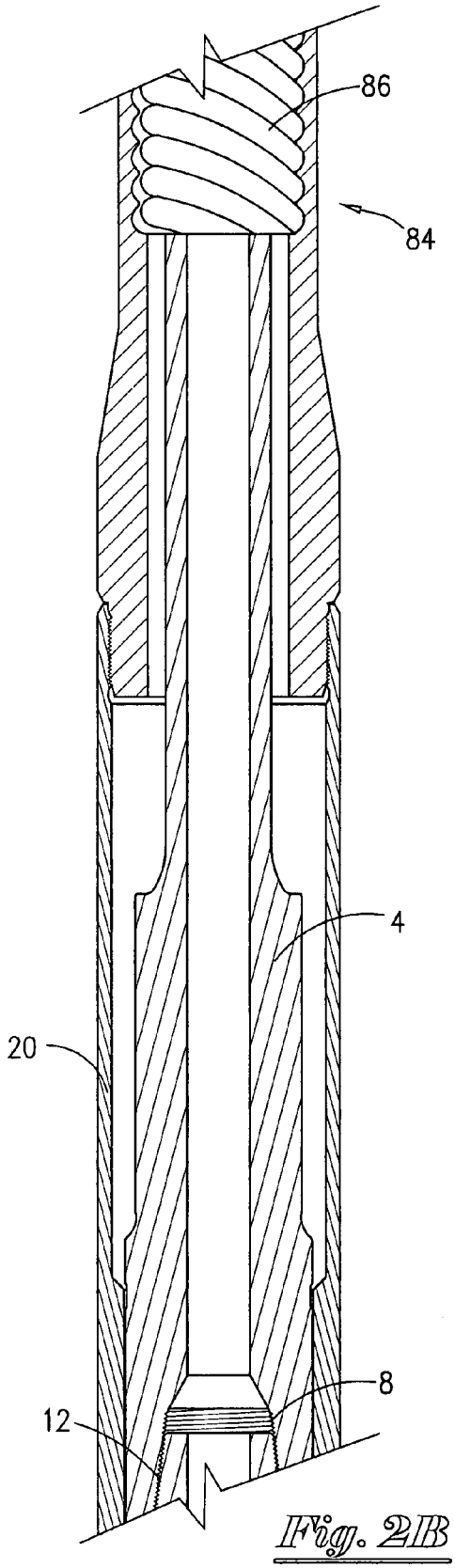
Figure 2C:
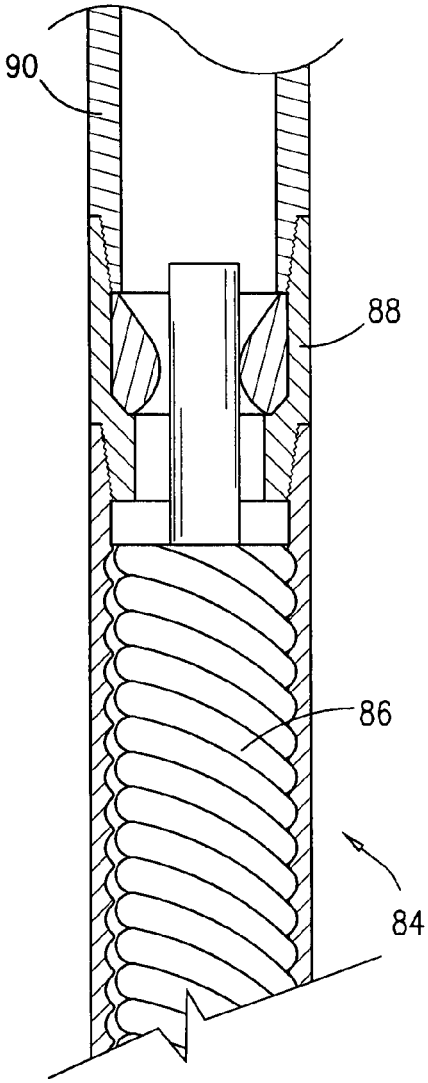

Referring now to FIGS. 2A, 2B and 2C, a cross-sectional view of the drilling apparatus 2 of the present disclosure will now be described. It should be noted that like numbers appearing in the various figures refer to like components. The outer bit 58 is disposed about the cross-over 64, and wherein the inner bit 70 is threadedly connected to the cross-over 64. The outer bit 58 is threadedly connected to the housing 40 via the external threads 46 and the internal threads 60. The driver 10 is threadedly connected to the cross-over 64 on one end and the driver 10 is also connected to the power shaft 4 via internal threads 8 and external threads 12. The sleeve 20 has a radial shoulder 80 within the previously described openings, . . . and wherein the pin 34*a* and pin 34*b* are connected to the radial shoulders of the openings so that the pins 34*a*, 34*b* are held in place as the pinions rotate as per the teachings of this description. Additionally, an indented bottom portion 82 of sleeve 20 is included (which includes the indentation 26 seen in FIG. 1), with the indented bottom portion 82 being threadedly attached to the thrust mandrel 50, and wherein the pins 34*a* and 34*b* are attached to the indented bottom portion 82 in order to fix the pins 34*a* and 34*b* in place during operation of the down hole motor.

The power shaft 4 is connected to the down hole motor 84 (also referred to as a mud motor). Down hole motors are commercially available from Robbins and Meyers Inc. under the name positive displacement motors. As seen in FIGS. 2A, 2B and 2C, the power shaft 4 is connected to the rotor 86 of the motor 84. The rotor 86 cooperates with a stator of the motor 84 and the fluid flow in order to impart a rotational movement to the power shaft 4, as understood by those of ordinary skill in the art. As seen specifically in FIG. 2C, the motor 84 is connected to a cross-over 88, and cross-over 88 is connected to the casing string 90 as per the teachings of this disclosure.

Figure 3:
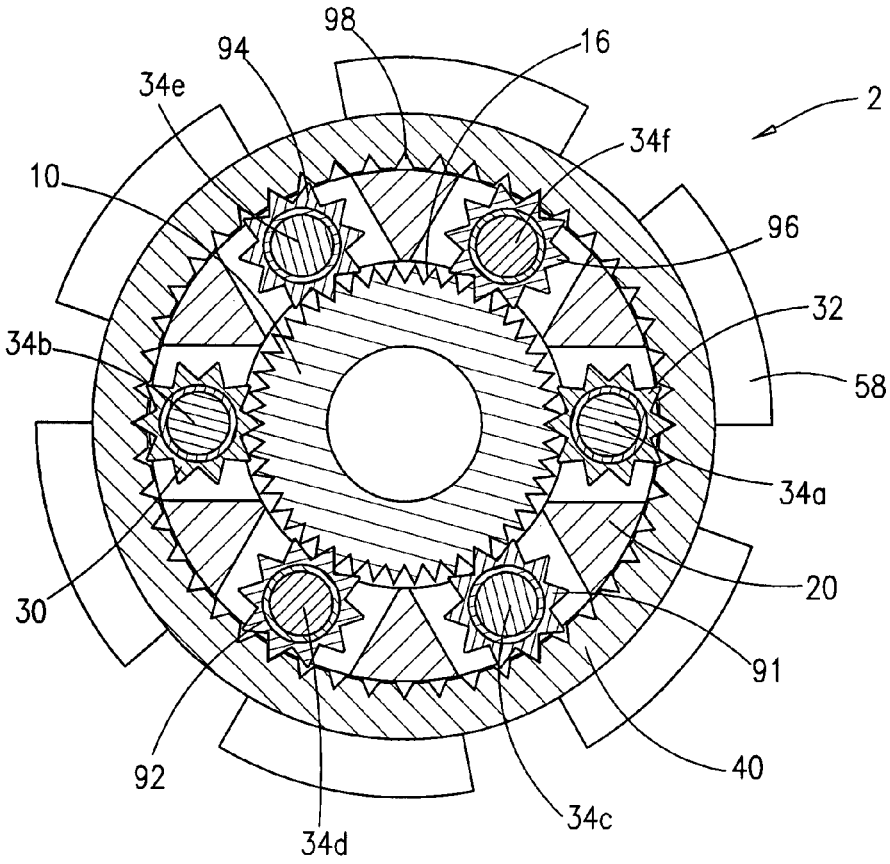
FIG. 3 is a cross-sectional view of the drilling apparatus taken from the line 3-3 in FIG. 2A.

FIG. 3 is a cross-sectional view of the drilling apparatus 2 taken from the line 3-3 in FIG. 2A. Hence, FIG. 3 shows the external cogs 16 of the driver 10. The pinion 32 is shown with the pin 34*a* disposed there through; the pinion 30 is shown with the pin 34*b* disposed there though; the pinion 91 is shown with the pin 34*c* disposed there through; the pinion 92 is shown with the pin 34*d* disposed there through; the pinion 94 is shown with the pin 34*e* disposed there through; the pinion 96 is shown with the pin 34*f* disposed there through. In operation, as the driver 10 rotates (due to its connection to the rotor), which in turn causes the pinions 28, 30, 32, 91, 92, 94 and 96 (due to the engagement of the cogs), which in turn imparts a counter rotation movement to the housing 40 via the engagement of the pinion cogs with the internal cogs 98 located on the housing 40.

Figure 4:
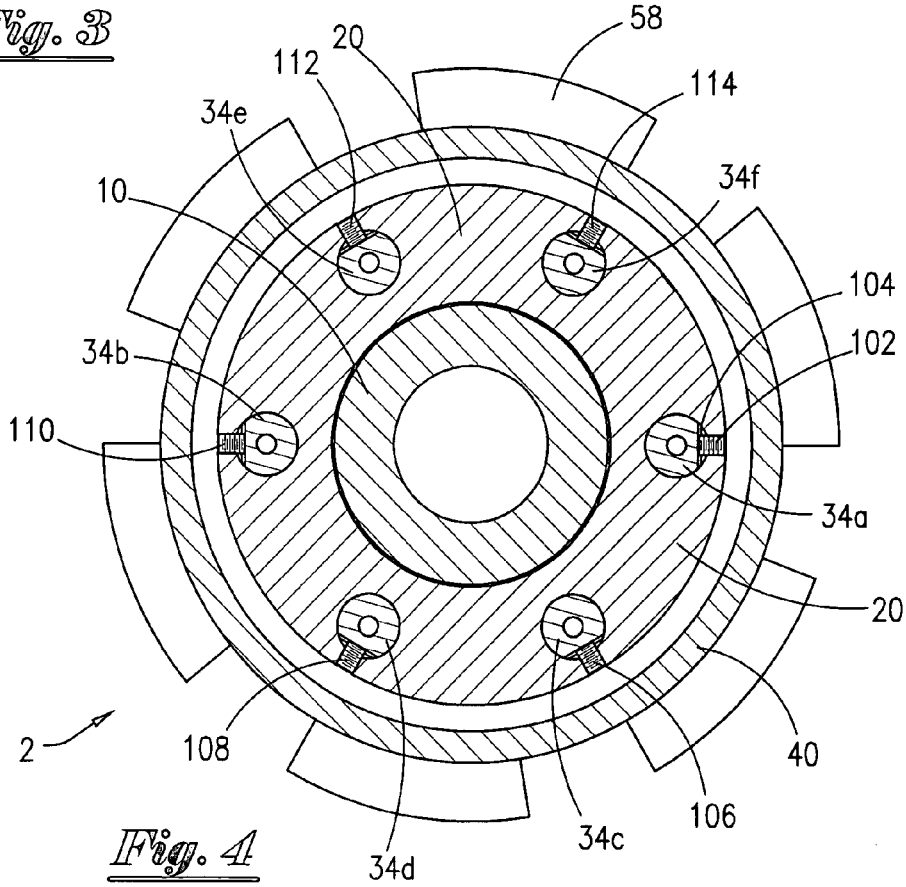
FIG. 4 is a cross-sectional view of the drilling apparatus taken from the line 4-4 in FIG. 2A.

Referring now to FIG. 4, a cross-sectional view of the drilling apparatus 2 taken from the line 4-4 in FIG. 2A will now be described. In this view, the end of pins 34*a*, 34*b*, 34*c*, 34*d*, 34*e*, 34*f* are configured to engage with the indented bottom portion 82 of sleeve 20, and in particular with a slot within the indented bottom portion 82. A set screw is used to attach the pin ends to the indented bottom portion 82. More specifically, the set screw 102 is configured to be inserted into the slot 104, and wherein the end of pin 34*a* is engaged with the set screw 102 so that the pin 34*a* is attached to the indented bottom portion 82. The other set screws include 106, 108, 110, 112, 114 and their engagement with the pin ends are the same as described with reference to set screw 102.

Figure 5:
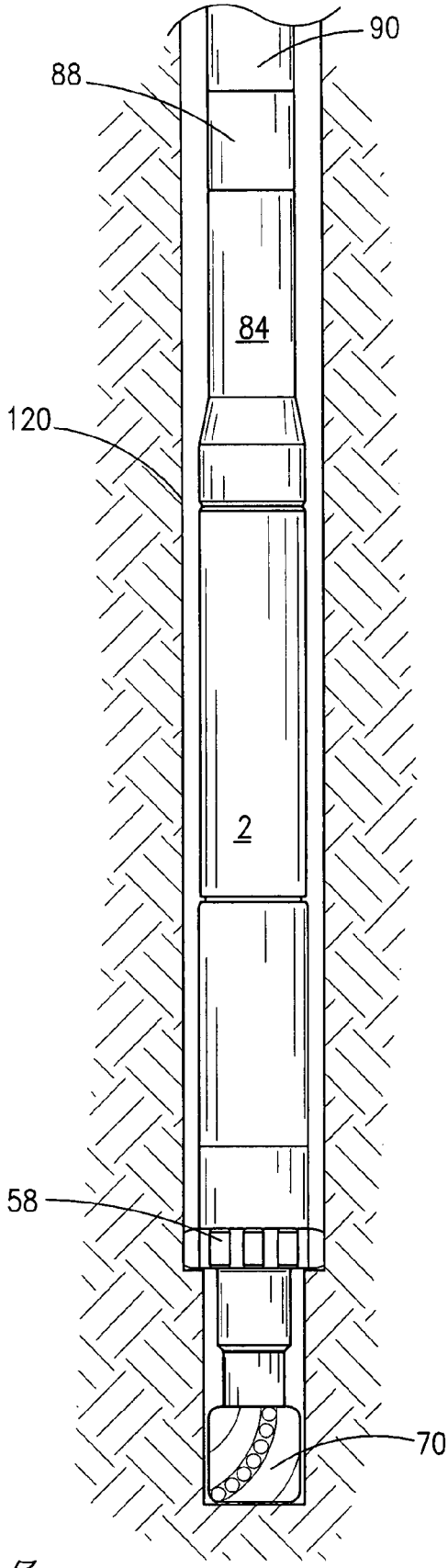
FIG. 5 is a schematic of the drilling apparatus system of the present disclosure disposed within a well.

Referring now to FIG. 5, a schematic of the drilling apparatus system of the present disclosure disposed within a well 120 will now be described. The down hole motor 84 is threadedly attached to the cross-over sub 88 as previously mentioned. Fluid flow through the inner bore of the casing string 90, and into the down hole motor 84 (through the rotor-stator), will produce the rotation of the inner bit 70 in a first direction, which in turn will impart a counter rotational movement to the outer bit 58, and wherein the action of the two bits in counter directions will produce a non-reactive force. As shown, the bits 70, 58 will be boring through the subterranean reservoirs. Hence, this non-reactive force allows the drilling of the well 120 with the attached casing string 90, which heretofore has not been possible due to the extreme torque applied to the casing string thread connections during prior art drilling operations.

Figure 6:
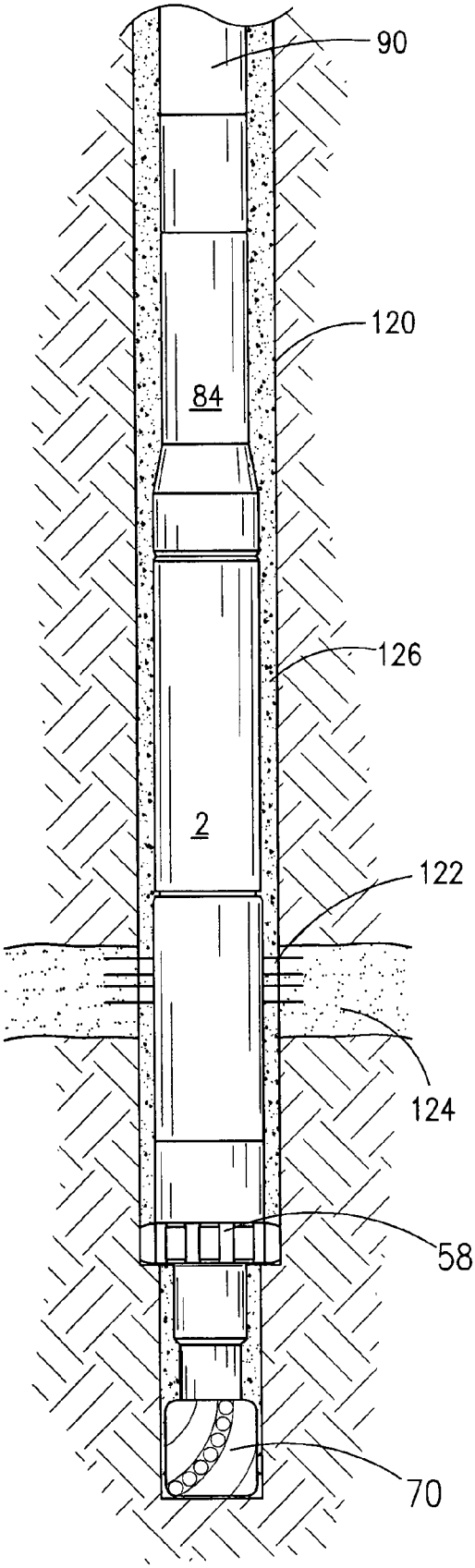
FIG. 6 is a schematic of the drilling apparatus system cemented within the well with perforations to a hydrocarbon reservoir.

As those of ordinary skill in the art will appreciate, many times a well progresses in a series of hole sections which are drilled in progressively smaller hole sizes. Casings are run to consolidate the current progress, to protect some zones from contamination as the well progresses (such as freshwater sources) and to give the well the ability to hold higher pressures. FIG. 6 is a schematic of the drilling apparatus system cemented within the well 120 with perforations 122 to a hydrocarbon reservoir 124. The cement is denoted by the numeral 126 and has been applied using known techniques to the annulus, wherein the annulus is the area between the outer portion of the apparatus 2 and casing 90 and the inner portion of the well 120.

Figure 7:
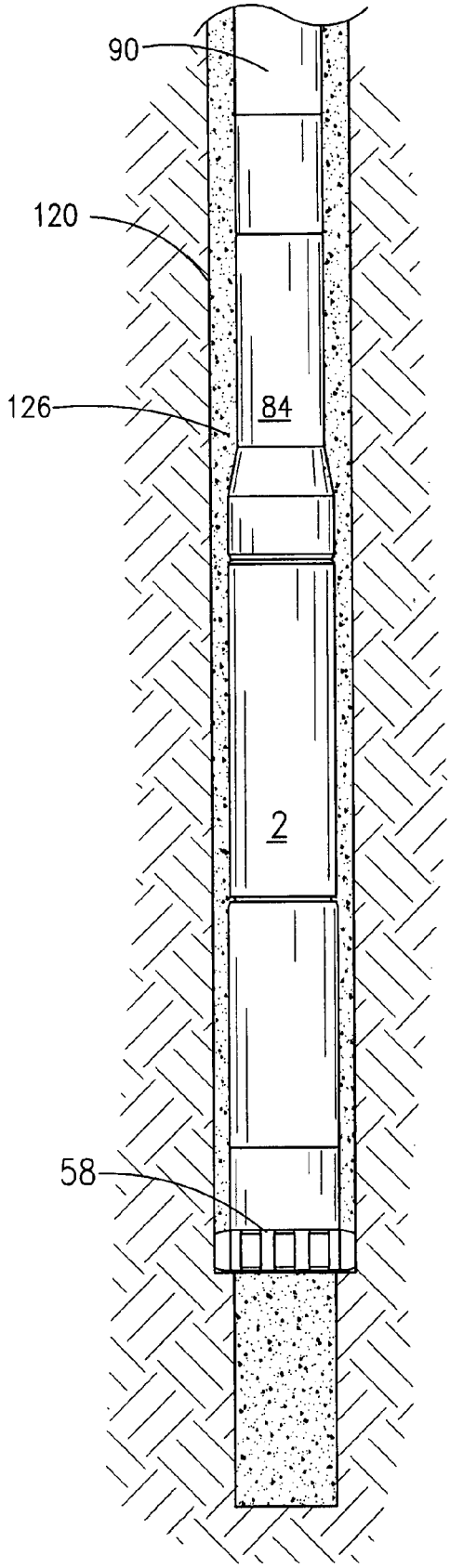
FIG. 7 is a schematic of the drilling apparatus system with the inner bit having been removed.
Figure 8:
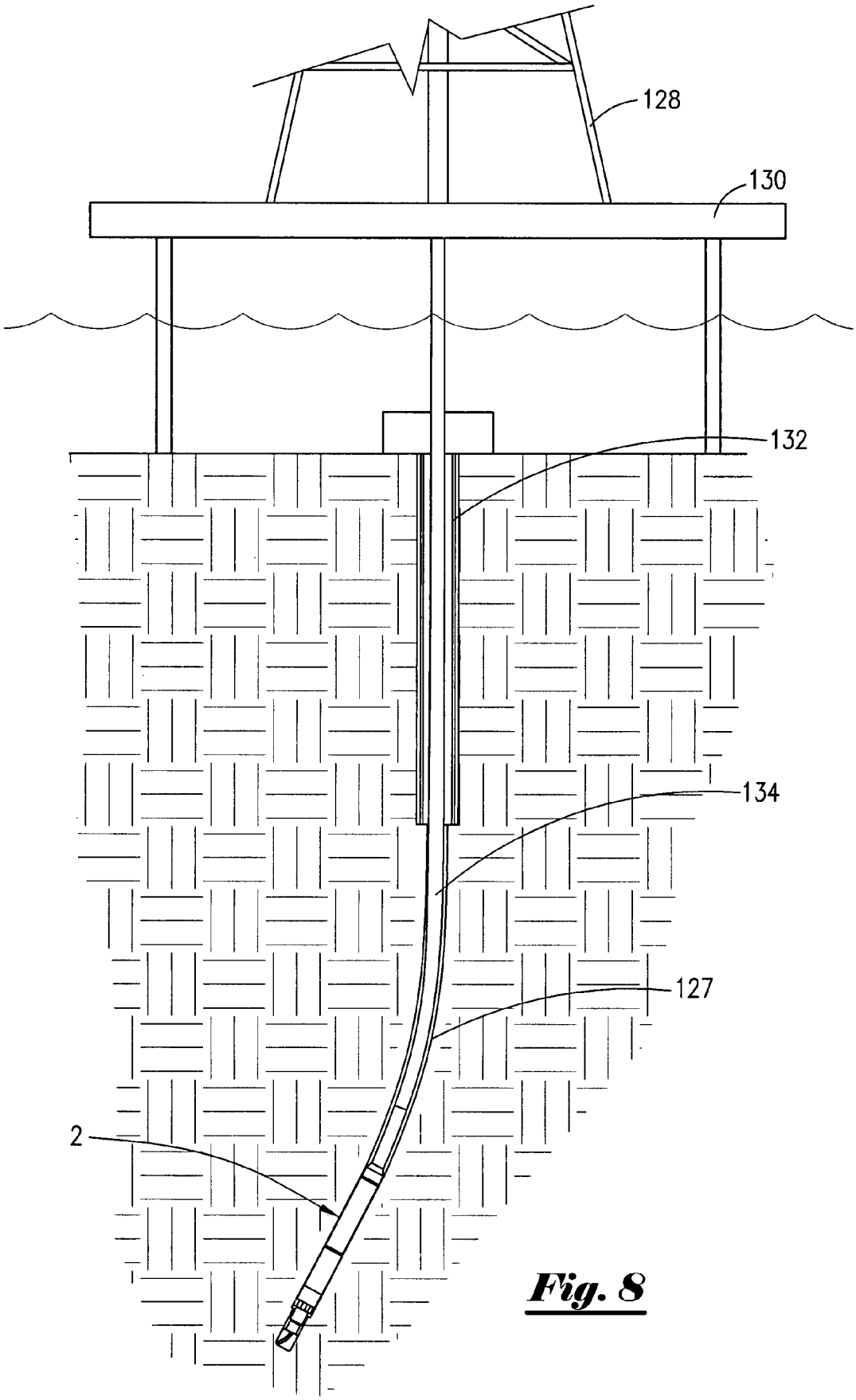
FIG. 8 is a schematic of the drilling apparatus system drilling a well from a rig.

Referring now to FIG. 7, a schematic of the drilling apparatus system with the inner bit (bit 70) having been removed is shown. In the position seen in FIG. 7, the casing string has been cemented in place. As per the teachings of the present invention, a second drilling apparatus system may be run into the hole, down the casing string and through the open end so that drilling may continue. This second drilling apparatus system can also have a casing string as the work string. Note that as seen in FIG. 7, the casing string 90 may be referred to as intermediate casing. In FIG. 8, a schematic of the drilling apparatus 2 drilling the well 127 from a rig 128. The rig is positioned on a drilling platform 130, and wherein the drilling platform 130 is located in water. FIG. 8 shows an intermediate casing string 132. The work string is the casing string 134, and wherein the well 127 can be drilled and subsequently cemented in place as per the teachings of this disclosure. It should be noted that a coiled tubing string can be used as the work string i.e. in place of the casing string. Due to the continuous nature of the tubular of the coiled tubing string, having a non-reactive torque system herein disclosed, allows operators the option of drilling wells utilizing coiled tubing as the work string.

Changes and modifications in the specifically described embodiments can be carried out without departing from the scope of the invention which is intended to be limited only by the scope of the appended claims and any equivalents thereof.

I claim:

1. An apparatus for drilling a well bore with a down hole motor, with the down hole motor having a power shaft for imparting rotational movement, the apparatus comprising:

a driver operatively connected to the power shaft, said driver having a cylindrical body, wherein an outer portion of said cylindrical body contains a plurality of cogs, wherein said driver contains an outer radial surface that is disposed within said sleeve, and wherein said outer radial surface contains an outer coating material for preventing wear with said sleeve during rotation;

a first bit having a first end, and wherein said first end is connected to said driver so that rotational movement of said driver is imparted to the first bit;

a sleeve disposed about a portion of said power shaft, said sleeve having a plurality of openings therein for placement of a plurality of pinions, said pinions having a pin disposed there through, and wherein said sleeve has a radial shoulder for attaching said plurality of pins;

a housing having a first end, and wherein said first end has a second bit formed thereon, and wherein said housing has an internal portion that contains internal cogs, and wherein said internal cogs engage said pinions so that as said driver rotates in a first direction, rotation is imparted to said pinions which in turn imparts a counter rotation to said second bit.

2. The apparatus of claim 1 further comprising thrust bearing means, operatively positioned within said housing, for transferring the axial and lateral loads of the apparatus during drilling.

3. The apparatus of claim 2 wherein the thrust bearing means comprises:

a thrust mandrel disposed between said housing and said driver;

a plurality of roller bearings operatively associated with said thrust mandrel.

4. The apparatus of claim 3 further comprising a trim spacer, disposed within said housing and abutting said thrust mandrel, for engaging with said thrust mandrel.

5. The apparatus of claim 4 wherein said first bit is offset relative to said second bit so that said first bit extends further into the well bore relative to said second bit.

6. The apparatus of claim 5 wherein said sleeve is attached to a coiled tubing string.

7. The apparatus of claim 5 wherein said sleeve is attached to a work string.

8. The apparatus of claim 5 wherein said sleeve is attached to a casing string.

9. A method of drilling a well with a motor having a power shaft, the method comprising:

providing a drilling apparatus, said drilling apparatus comprising:

a driver operatively connected to the power shaft, said driver having a body, containing a plurality of cogs;

a first bit having a first end, and wherein said first end is connected to said driver so that rotational movement of said driver is imparted to the first bit;

a sleeve disposed about a portion of said power shaft, said sleeve having a plurality of openings therein for placement of a plurality of pinions, said pinions having a pin disposed there through, and wherein said sleeve has a radial shoulder for attaching said plurality of pins;

a housing having, a second bit formed thereon, and wherein said housing has an internal portion that contains a plurality of internal cogs engaging said pinions;

providing a casing string concentrically placed within the well, said casing string being operatively connected to said sleeve;

rotating the power shaft via a fluid flow down an internal portion of the casing string and the drilling apparatus;

rotating the first bit in a first direction;

drilling the well with the first bit;

rotating the cogs on said driver;

engaging the pinions with the cogs on the driver;

engaging the internal cogs on the housing;

rotating the housing in a counter direction relative to the first bit;

rotating the second bit in the counter direction;

drilling the well with the second bit.

10. The method of claim 9 wherein the first bit is offset relative to the second bit so that the first bit extends further into the well relative to the second bit.

11. The method of claim 10 further comprising:

terminating the flow of the fluid down the internal portion of the casing string and the drilling apparatus;

terminating the drilling of the well with the first bit and the second bit.

12. The method of claim 11 further comprising:

retrieving an internal portion of the drilling apparatus, which includes retrieving the first bit, from the well.

13. The method of claim 11 further comprising:

cementing the casing string in place within the well;

perforating the casing sting so that the inner portion of the casing string is in communication with a subterranean reservoir.

14. A device for boring a well, the device being attached to a motor and wherein the motor has a power shaft for imparting rotational movement, the device comprising:

a driver mandrel operatively connected to the power shaft, said driver mandrel containing a cylindrical body;

a first bit member having a first end and a second end, and wherein said first end is connected to said driver mandrel so that rotational movement of said driver mandrel is imparted to the first bit member, and wherein the first bit member has an inner bore, and wherein said second end has a first bit;

a sleeve disposed about a portion of said power shaft, and wherein said sleeve has a radial shoulder;

a casing string attached to said sleeve, and wherein said casing string is designed to be permanently placed within the well once the boring is completed, and wherein an inner bore of the casing string is in fluid communication with the inner bore of the first bit;

a housing disposed about said driver mandrel;

a second bit member attached to the housing;

a planetary gear anchored to said radial shoulder and disposed between said driver mandrel and said housing, and wherein said planetary gear is adapted for imparting rotation from said driver mandrel to said housing in a counter radial direction.

15. The device of claim 14 further comprising thrust bearing means, operatively placed between said housing and said driver mandrel, for transferring the axial and lateral loads generated during boring.

16. The device of claim 15 wherein the thrust bearing means comprises a thrust mandrel and a plurality of ball bearings operatively associated with said thrust mandrel.

17. The device of claim 14 further comprising:

a bearing assembly having a first end and a second end, with the second end of said housing being rotably associated with said first end of said bearing assembly so that rotation of said first bit member and said second bit member is facilitated.

18. The device of claim 17 wherein said first bit member comprise:

a first set of cutter teeth positioned to drill the well in said first rotational direction; and wherein said second bit member comprises:

a second set of cutter teeth positioned to drill the well in said counter rotational direction.

19. The device of claim 18 wherein said first bit member is offset relative to said second bit member so that said first bit member extends further into the well relative to said second bit member.

* * * * *